US008752991B2

(12) United States Patent
Owada

(10) Patent No.: US 8,752,991 B2
(45) Date of Patent: Jun. 17, 2014

(54) VEHICLE LIGHTING DEVICE

(75) Inventor: Ryotaro Owada, Kawasaki (JP)

(73) Assignee: Stanley Electric Co., Ltd., Tokyo (JP)

( * ) Notice: Subject to any disclaimer, the term of this patent is extended or adjusted under 35 U.S.C. 154(b) by 258 days.

(21) Appl. No.: 13/307,744

(22) Filed: Nov. 30, 2011

(65) Prior Publication Data

US 2012/0140508 A1 Jun. 7, 2012

(30) Foreign Application Priority Data

Dec. 1, 2010 (JP) ..... 2010-268049

(51) Int. Cl.
*F21V 5/00* (2006.01)

(52) U.S. Cl.
USPC ..... 362/522; 362/521; 362/538; 362/545

(58) Field of Classification Search
USPC ..... 362/520–522, 538–539, 543–545
See application file for complete search history.

(56) References Cited

U.S. PATENT DOCUMENTS

2004/0120158 A1 6/2004 Tatsukawa et al.
2010/0165653 A1 * 7/2010 Ookubo et al. ..... 362/539

FOREIGN PATENT DOCUMENTS

JP 2004-095480 3/2004

* cited by examiner

*Primary Examiner* — Jason Moon Han
(74) *Attorney, Agent, or Firm* — Kenealy Vaidya LLP

(57) ABSTRACT

A vehicle lighting device can include a plurality of semiconductor light-emitting devices and a projector lens configured to illuminate a front of a vehicle with light emitted from the semiconductor light-emitting devices. The projector lens can include a plurality of incidence surfaces which perform main control of light distribution, and respectively correspond to the semiconductor light-emitting devices. A single exit surface of the projector lens can include a plurality of exit regions which emits light entering through the incidence surfaces into the projector lens, wherein the exit regions provided next to each other overlap with each other.

3 Claims, 15 Drawing Sheets

VEHICLE LIGHTING DEVICE

This application claims the priority benefit under 35 U.S.C. §119 of Japanese Patent Application No. 2010-268049 filed on Dec. 1, 2010, which is hereby incorporated in its entirety by reference.

BACKGROUND

1. Field

The presently disclosed subject matter relates to a vehicle lighting device.

2. Description of the Related Art

Conventionally, a semiconductor light-emitting device such as a light-emitting diode (LED) is widely used as a light source in a vehicle lighting device such as a headlight for a car. With this type of vehicle lighting device, it is possible to form a light distribution pattern having a desired shape, for example, by properly arranging a plurality of semiconductor light-emitting devices. However, it is difficult to form a light distribution pattern having a desired luminous intensity distribution therewith.

Accordingly, for example, Japanese Patent No. 4002159 proposes a vehicle lighting device with which a light distribution pattern having a desired shape and a desired luminous intensity distribution can be formed by combining a plurality of types of lighting units having different light-illumination modes.

SUMMARY

However, in the vehicle lighting device disclosed by Japanese Patent No. 4002159, a projector lens which emits light to the front of a vehicle is provided for each lighting unit. Hence, when light is emitted, a dark portion is generated between the exit surfaces (light-emitting surfaces) of the projector lenses. That is, a light-emitting portion does not emit light as a whole, and the vehicle lighting device does not look good when emitting light.

Furthermore, in general, the exit surface of a projector lens is convex in order to control light distribution. Hence, a light-emitting portion is formed by intermittently arranging a plurality of convex surfaces. Therefore, a light-emitting portion cannot be formed in a smooth shape, or cannot fit the design of the external appearance of a vehicle. That is, the external appearance of a vehicle lighting device is not desirable.

Furthermore, in order to obtain a desired light distribution pattern, a plurality of projector lenses is needed to be combined in an appropriate positional relation. Hence, the costs for combining the projector lenses increase, and also light distribution performance may be decreased by the errors made in combining the projector lenses.

It may seem that the problems described above can be solved by integrating a plurality of projector lenses into one. A single projector lens may be obtained by simply connecting a plurality of projector lenses with each other, but the exit surface of the obtained single projector lens has a plurality of convex portions. That is, although the necessity to combine a plurality of projector lenses is eliminated thereby, the problems about the looks of a vehicle lighting device at the time of emitting light and the external appearance thereof are still unsolved.

The presently disclosed subject matter is made in the view of the circumstances, and one aspect of the presently disclosed subject matter is to provide a vehicle lighting device using a semiconductor light-emitting device as a light source, the vehicle lighting device which looks excellent when emitting light and has an excellent external appearance.

According to another aspect of the presently disclosed subject matter, there is provided a vehicle lighting device including: a plurality of semiconductor light-emitting devices; a projector lens which illuminates a front of a vehicle with light emitted from the semiconductor light-emitting devices, the projector lens including: a plurality of incidence surfaces which performs main control of light distribution, and respectively corresponds to the semiconductor light-emitting devices; and a single exit surface including a plurality of exit regions which emits the light entering through the incidence surfaces into the projector lens, wherein the exit regions provided next to each other overlap with each other.

BRIEF DESCRIPTION OF THE DRAWINGS

The above and other characteristics, advantageous effects, and features of the presently disclosed subject matter will become more fully understood from the detailed description given hereinbelow and the accompanying drawings which are given by way of illustration only, and thus are not intended as definitions of limits of the presently disclosed subject matter, wherein.

DETAILED DESCRIPTION OF EXEMPLARY EMBODIMENTS

In the following, an exemplary embodiment of the presently disclosed subject matter is described with reference to the accompanying drawings.

Figure 1:
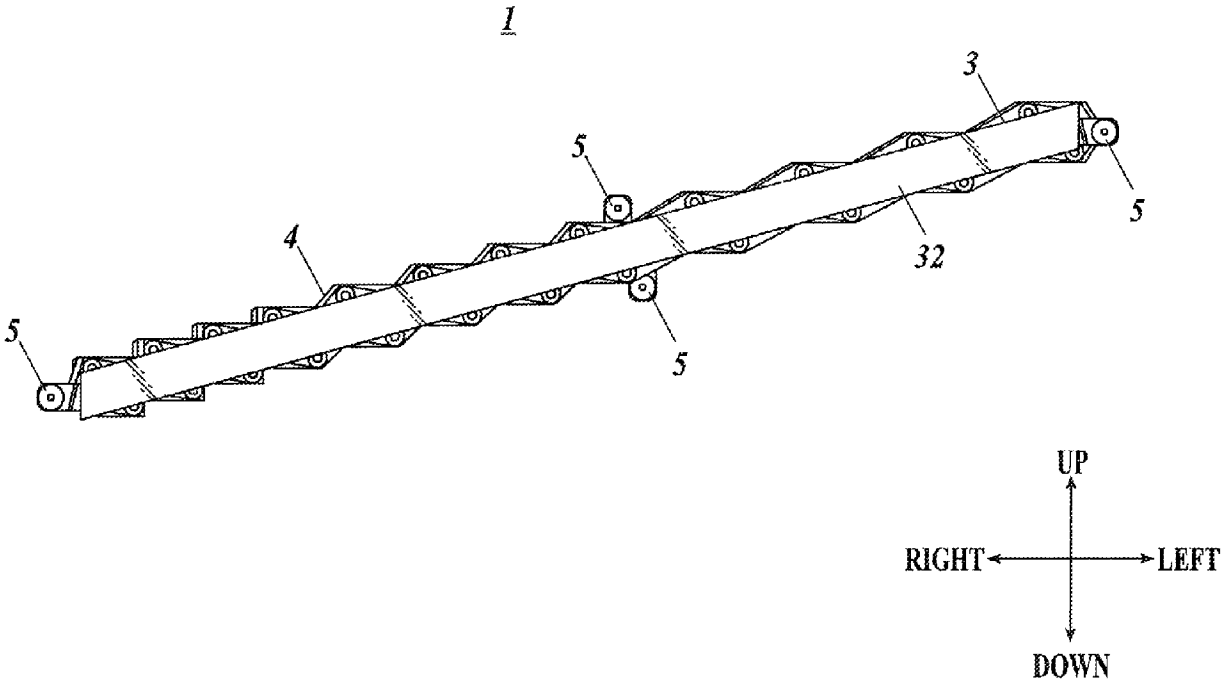
FIG. 1 is an elevation view of a vehicle lighting device according to an exemplary embodiment of the presently disclosed subject matter.
Figure 2:
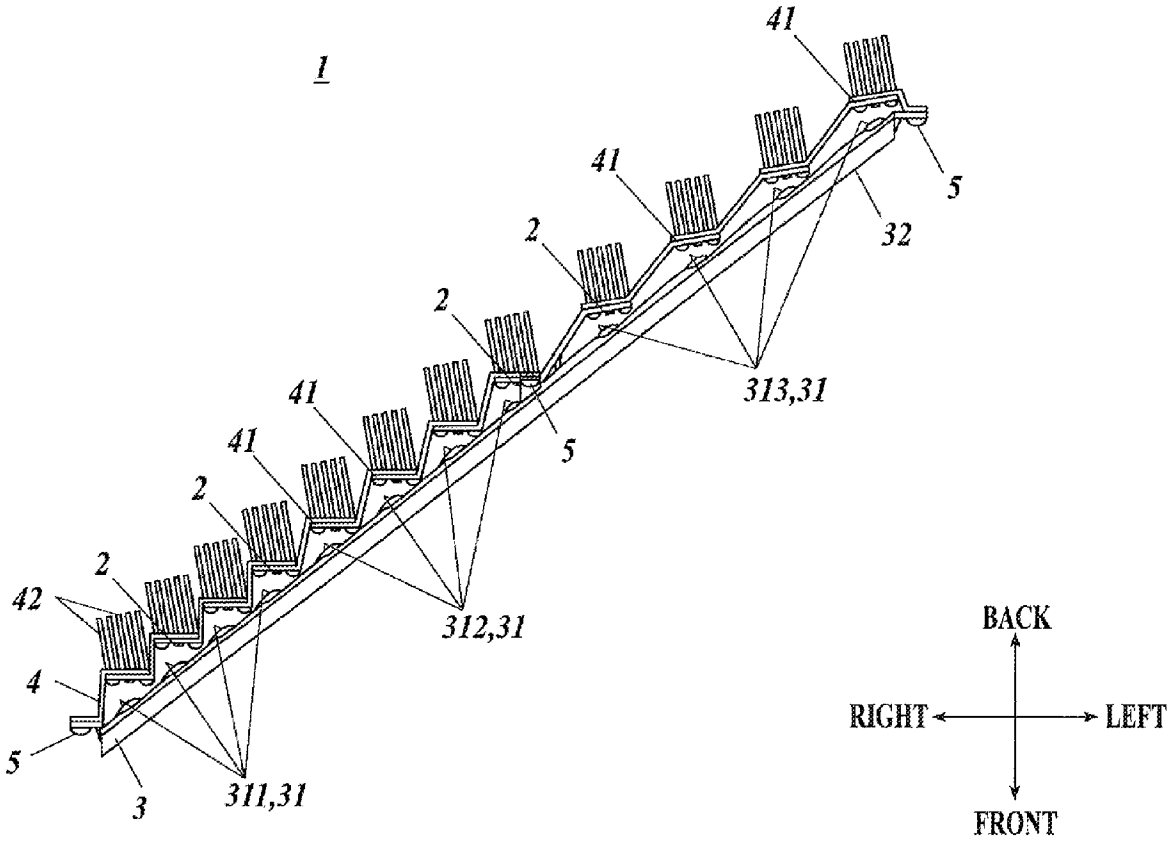
FIG. 2 is a plan view of the vehicle lighting device of FIG. 1.
Figure 3:
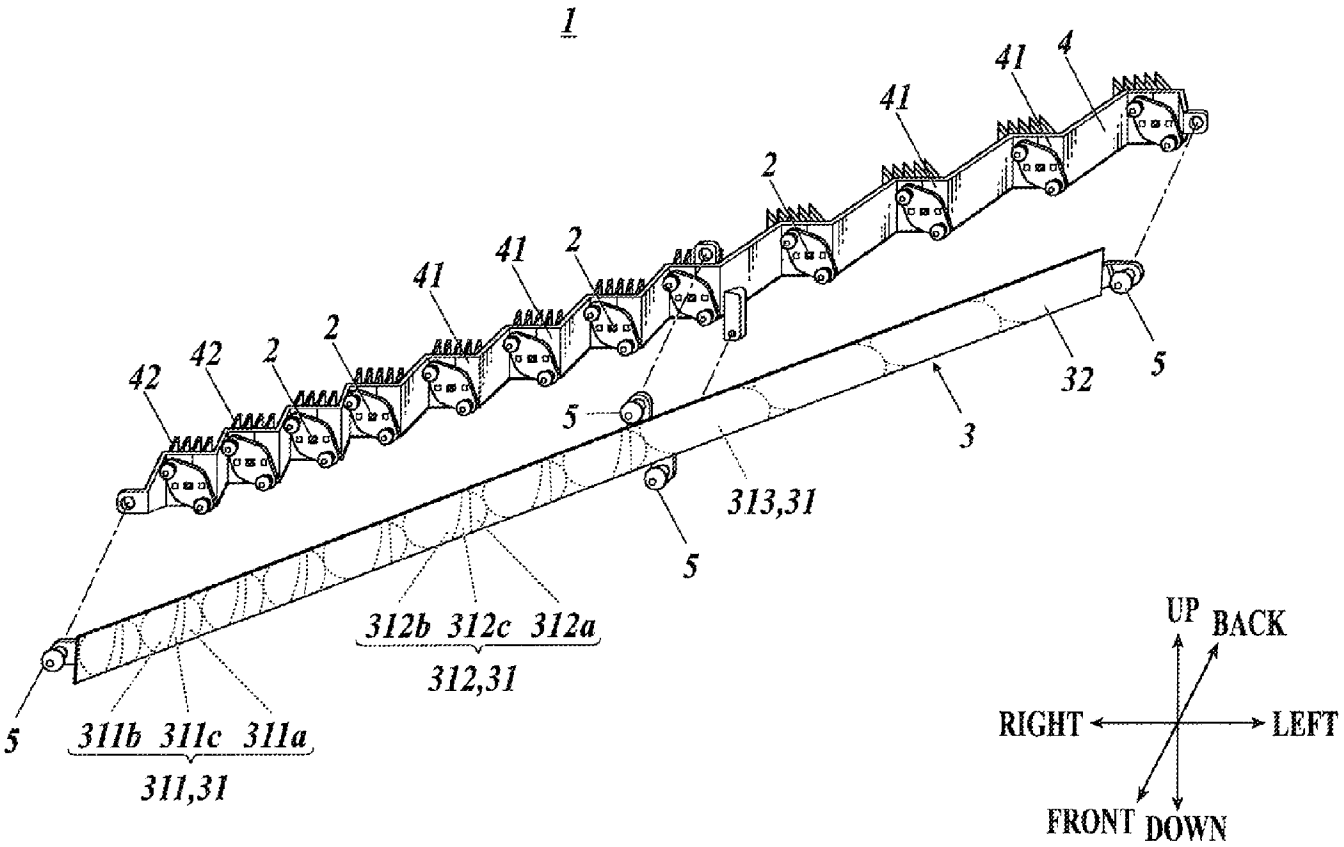
FIG. 3 is an exploded perspective view of the vehicle lighting device of FIG. 1.

FIG. 1 is an elevation view of a vehicle lighting device 1 according to an exemplary embodiment of the presently disclosed subject matter. FIG. 2 is a plan view of the vehicle lighting device 1. FIG. 3 is an exploded perspective view of the vehicle lighting device 1.

Vehicle lighting devices are respectively fixed onto the right and the left of the front part of a vehicle. However, in the following, the vehicle lighting device 1 fixed onto the left of the front part of a vehicle is described, and the description of a vehicle lighting device fixed onto the right thereof is omitted. Furthermore, words of "up", "down", "front", "back", "left", and "right" used hereinbelow respectively indicate directions viewed from a vehicle (not shown) onto which the vehicle lighting device 1 is fixed, and the words respectively correspond to the words in the drawings, unless different explanation is made.

As shown in FIGS. 1 to 3, the vehicle lighting device 1 is fixed onto the left of the front part of a vehicle (not shown), and forms low beams for left-hand traffic by illuminating the front of the vehicle with light. The vehicle lighting device 1 inclines upward and backward from the inner side (right) of the vehicle to the outer side (left) thereof so as to fit the design of the external appearance of the front part of the vehicle. The vehicle lighting device 1 includes twelve LEDs 2 and a projector lens 3.

The LEDs 2 are semiconductor light-emitting devices (an LED package) of the presently disclosed subject matter, and are respectively fixed on steps 41 of a bracket 4 which is formed stepwise. The bracket 4 is long and inclines upward and backward from the right to the left. The steps 41 are at right angles to the front-back direction, and the further left a step 41 is located on the bracket 4, the further back the step 41 is located. More specifically, the steps 41 of the bracket 4 are arranged at predetermined intervals so as to respectively face incidence surfaces 31 (described below) of the projector lens 3. In addition, among the steps 41, four steps 41 on the left of the bracket 4 face in a direction inclined at an angle of 20 degrees from the front to the left. Each LED 2 is fixed onto the center of the front surface of its corresponding step 41. Among the LEDs 2, eight LEDs 2 provided on the right emit light forward, and the rest of the LEDs 2, namely, four LEDs 2 provided on the left, emit light in a direction inclined at an angle of 20 degrees from the front to the left. Radiation fins 42 are formed on the back surface of each step 41 of the bracket 4.

The projector lens 3 illuminates the front of the vehicle with the light emitted from the LEDs 2. The projector lens 3 is long and inclines upward and backward from the right to the left. The projector lens 3 is fixed to the bracket 4 with four screws 5 in a state in which the projector lens 3 covers the front of the LEDs 2. On the back surface of the projector lens 3, twelve incidence surfaces 31 are arranged in the longer direction, the incidence surfaces 31 through which the light emitted from the LEDs 2 respectively enters so as to enter into the projector lens 3. The front surface of the projector lens 3 is plane with the upper part thereof inclined backward, and constitutes an exit surface 32 which emits the light from the projector lens 3.

Each incidence surface 31 of the projector lens 3 is convex, and has an optical axis Ax (shown in FIG. 4) which passes through an optical origin for the incidence surface 31, and which is along the front-back direction. The incidence surfaces 31 perform main control of light distribution to form low beams. The incidence surfaces 31 are arranged in such a way as to respectively correspond to the LEDs 2. More specifically, each incidence surface 31 is arranged in front of its corresponding LED 2 in such a way that the optical origin for the incidence surface 31 is located at a corner portion of a light-emitting portion of the LED 2. There is no difference in level (no step) between the incidence surfaces 31 which are next to each other, and the incidence surfaces 31 next to each other are directly connected with each other. Among the twelve incidence surfaces 31, four incidence surfaces 31 arranged on the right are first incidence surfaces 311, four incidence surfaces 31 arranged on the center are second incidence surfaces 312, and four incidence surfaces 31 arranged on the left are third incidence surfaces 313. The incidence surfaces 311, 312, and 313 perform different light distribution control (described below).

Each of the first incidence surfaces 311 is composed of a first refracting surface 311*a* formed on the own-lane side (left), a second refracting surface 311*b* formed on the opposite-lane side (right), and a third refracting surface 311*c* formed between the first refracting surface 311*a* and the second refracting surface 311*b* (shown in FIG. 3). The borderline between the first refracting surface 311*a* and the third refracting surface 311*c* and the borderline between the second refracting surface 311*b* and the third refracting surface 311*c* are almost along the up-down direction when viewed from the front. More specifically, the borderline between the first refracting surface 311*a* and the third refracting surface 311*c* is located a little left from an up-down direction section of the projector lens 3, the up-down direction section which includes an optical axis Ax, and the borderline between the second refracting surface 311*b* and the third refracting surface 311*c* almost coincides with the up-down direction section which includes the optical axis Ax.

In a similar manner to each of the first incidence surfaces 311, each of the second incidence surfaces 312 is composed of a first refracting surface 312*a* formed on the own-lane side (left), a second refracting surface 312*b* formed on the opposite-lane side (right), and a third refracting surface 312*c* formed between the first refracting surface 312*a* and the second refracting surface 312*b* (shown in FIG. 3). The borderline between the first refracting surface 312*a* and the third refracting surface 312*c* and the borderline between the second refracting surface 312*b* and the third refracting surface 312*c* are almost along the up-down direction when viewed from the front. More specifically, the borderline between the first refracting surface 312*a* and the third refracting surface 312*c* is located a little left from an up-down direction section of the projector lens 3, the up-down direction section which includes an optical axis Ax, and the borderline between the second refracting surface 312*b* and the third refracting surface 312*c* almost coincides with the up-down direction section which includes the optical axis Ax.

Figure 4:
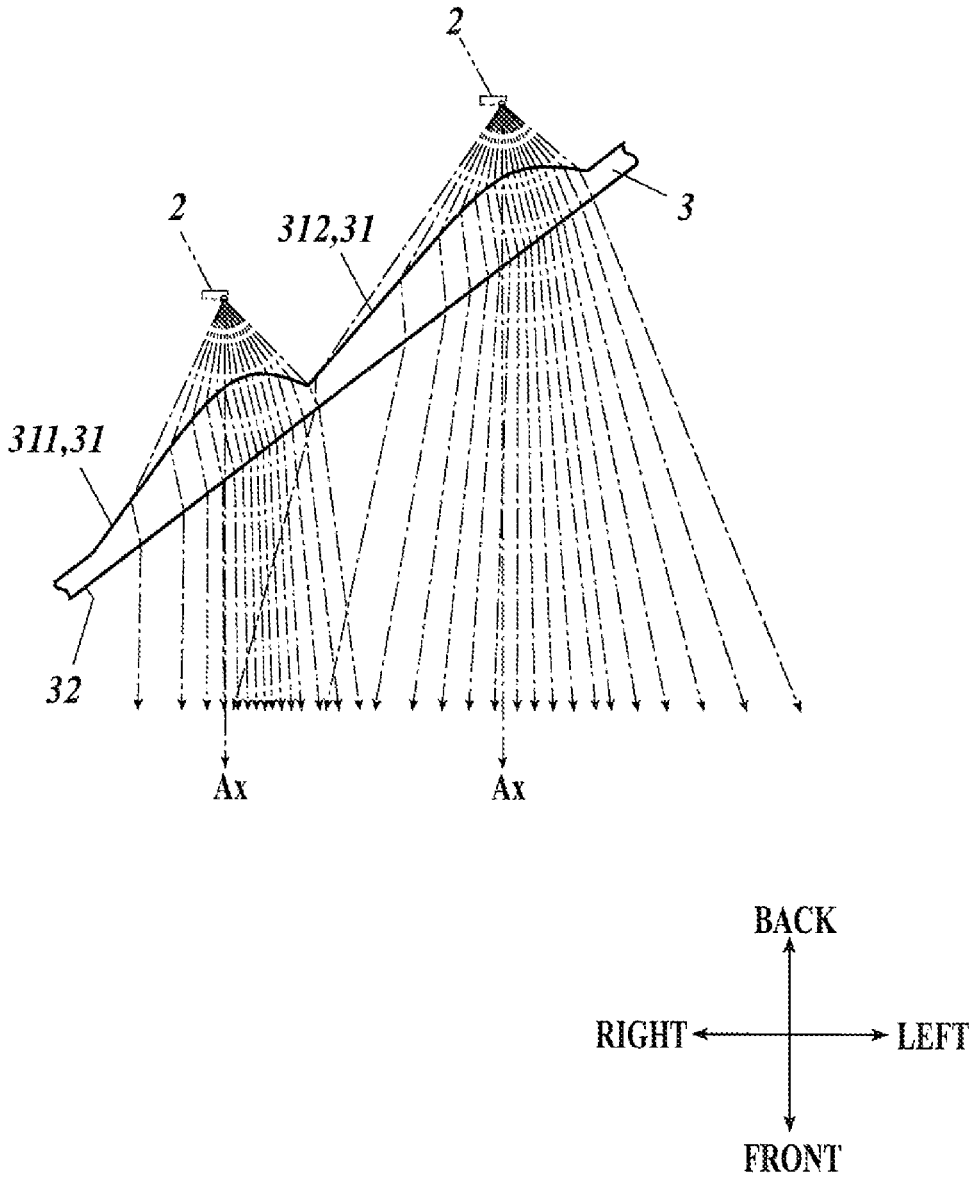
FIG. 4 shows a beam trajectory on a longer direction section of a projector lens of the vehicle lighting device of FIG. 1.

FIG. 4 shows a beam trajectory on a longer direction section of the projector lens 3.

As shown in FIG. 4, the first incidence surface 311 refracts the light emitted from its corresponding LED 2 to diffuse the light both to the right and to the left through the exit surface 32. Furthermore, the second incidence surface 312 refracts the light emitted from its corresponding LED 2 to diffuse the light both to the further right and to the further left through the exit surface 32 than the light passing through the first incidence surface 311. Furthermore, although not being shown, the third incidence surface 313 refracts the light emitted from its corresponding LED 2 to diffuse the light both to the further right and to the further left through the exit surface 32 than the light passing through the second incidence surface 312. The exit surface 32 includes exit regions which emit the light entering into the projector lens 3 through the incidence surfaces 31, respectively. The exit regions arranged next to each other overlap with each other. Consequently, the exit surface 32 emits the light with no gap in the longer direction of the projector lens 3. In the case where there is a difference in level (a step) between incidence surfaces arranged next to each other, and exit regions arranged next to each other are made to overlap with each other in the exit surface 32, no-intended illumination light, such as glare, and/or the loss of light is caused. On the contrary, in the presently disclosed subject matter, the incidence surfaces 31 arranged next to each other are directly connected with each other with no difference in level therebetween. Accordingly, such no-intended illumination light and/or the loss of light can be prevented from being caused.

Figure 5:
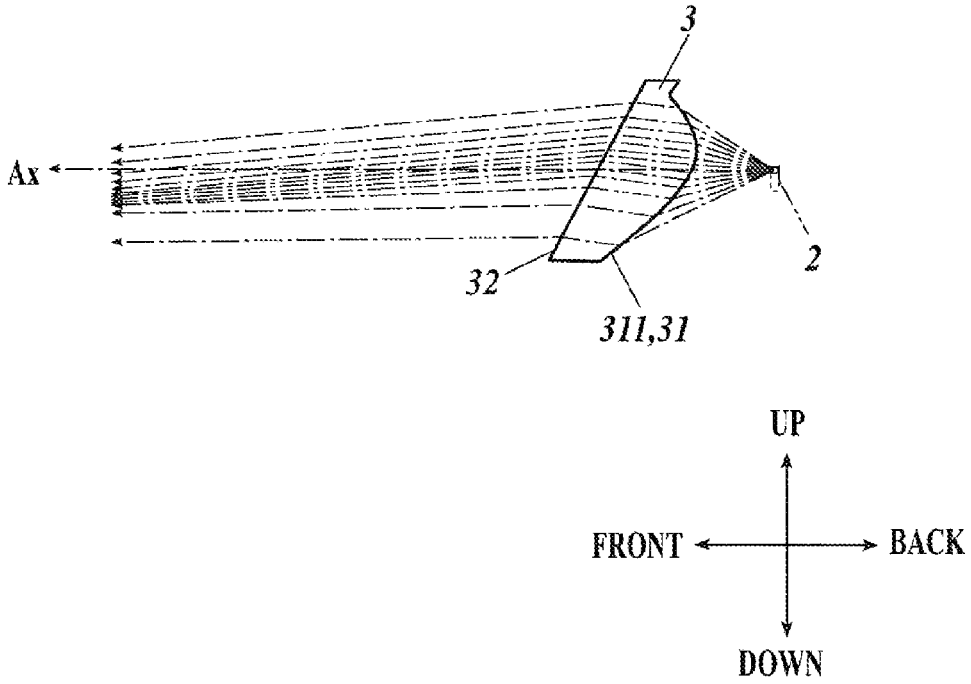
FIG. 5 shows a beam trajectory on an up-down direction section of the projector lens of FIG. 1.

FIG. 5 shows a beam trajectory on the up-down direction section of the projector lens 3.

As shown in FIG. 5, the first incidence surface 311 refracts the light emitted from its corresponding LED 2 in such a way that some of the light travels downward from the optical axis Ax through the exit surface 32, and the rest of the light travels along the optical axis Ax through the exit surface 32. Although not being shown, the second incidence surface 312 refracts the light emitted from its corresponding LED 2 in such a way that some of the light travels downward from the optical axis Ax through the exit surface 32, and the rest of the light travels along the optical axis Ax through the exit surface 32. Although not being shown, the third incidence surface 313 refracts the light emitted from its corresponding LED 2 in such a way that the light travels further down than the light passing through the second incidence surface 312.

Of the first incidence surface 311, the first refracting surface 311*a* provided on the own-lane side refracts the light emitted from its corresponding LED 2 in such a way that, on the up-down direction section, some of the light is emitted from the exit surface 32 to travel downward from the optical axis Ax, and the rest of the light is emitted from the exit surface 32 to travel along the optical axis Ax. Furthermore, of the first incidence surface 311, the second refracting surface 311*b* and the third refracting surface 311*c* refract the light emitted from their corresponding LED 2 in such a way that, on the up-down direction section, the light is emitted from the exit surface 32 to travel downward from the optical axis Ax. In addition, the second refracting surface 311*b* refracts the light emitted from its corresponding LED 2 in such a way that the light is emitted from the exit surface 32 to travel further down than the light passing through the first refracting surface 311*a*. The first, second, and third refracting surfaces 311*a*, 311*b*, and 311*c* refract the light emitted from their corresponding LED 2 by making the deflection angle to emit the light from the exit surface 32 downward become gradually larger as the light is emitted away from the optical axis Ax in the up-down direction.

The first, second, and third refracting surfaces 312*a*, 312*b*, and 312*c* of the second incidence surface 312 refract the light emitted from their corresponding LED 2 in a similar matter to the first, second, and third refracting surfaces 311*a*, 311*b*, and 311*c* of the first incidence surface 311, respectively.

Next, a light distribution pattern (low beams) formed in front of the vehicle through the projector lens 3 is described.

Figure 6:
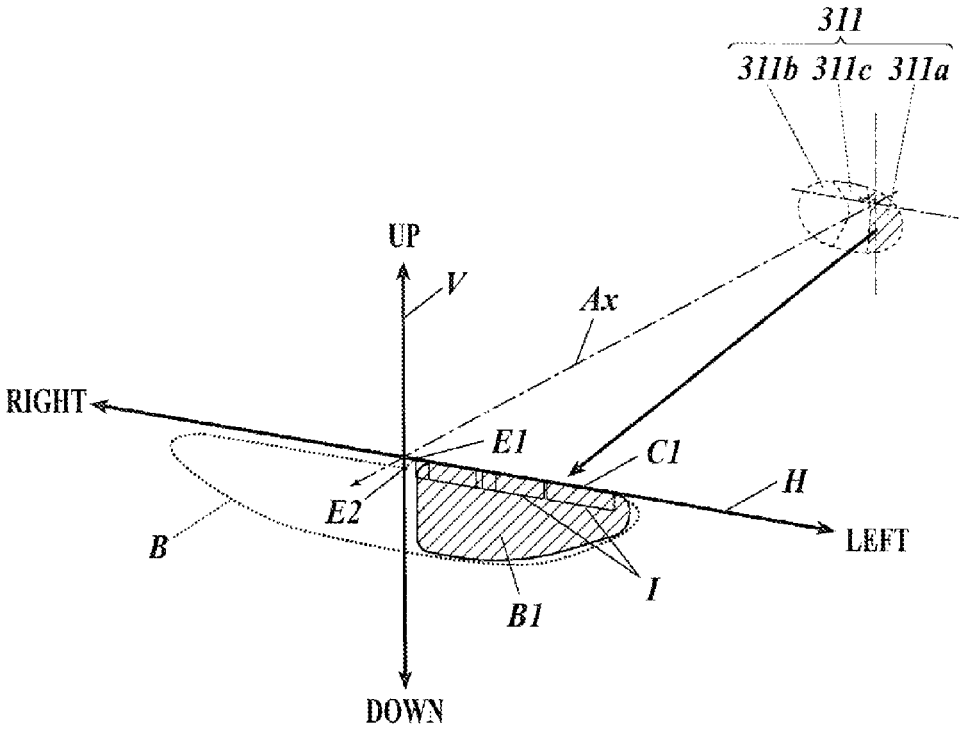
FIG. 6 shows a projection image formed by a first refracting surface of a first incidence surface and an exit surface of the projector lens of FIG. 1.
Figure 7:
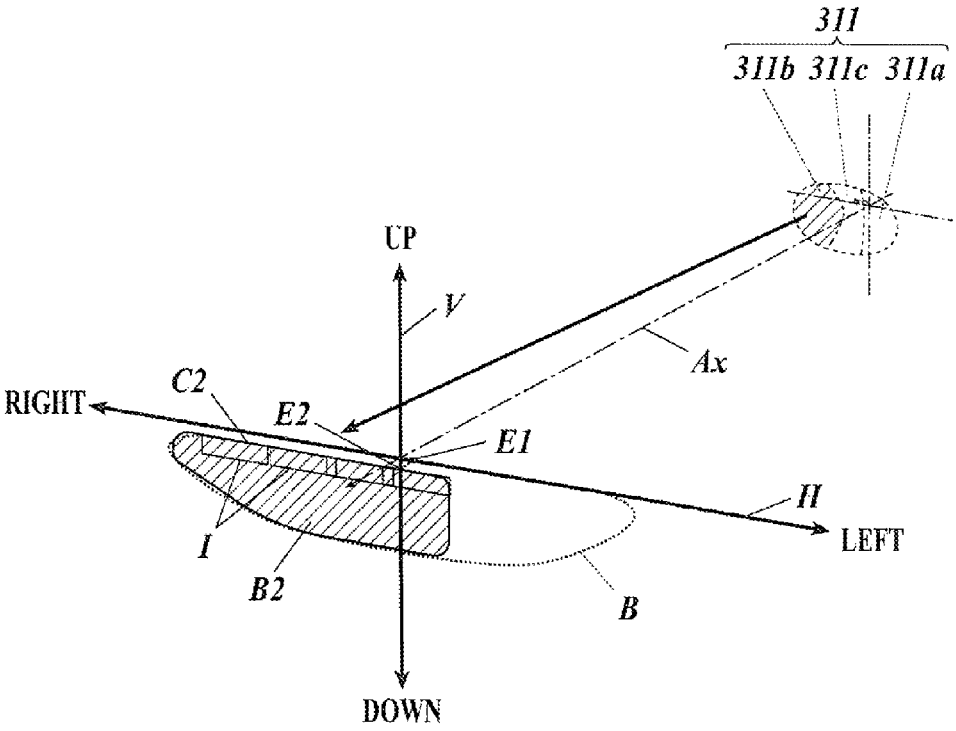
FIG. 7 shows a projection image formed by a second refracting surface of the first incidence surface and the exit surface of the projector lens of FIG. 1.
Figure 8:
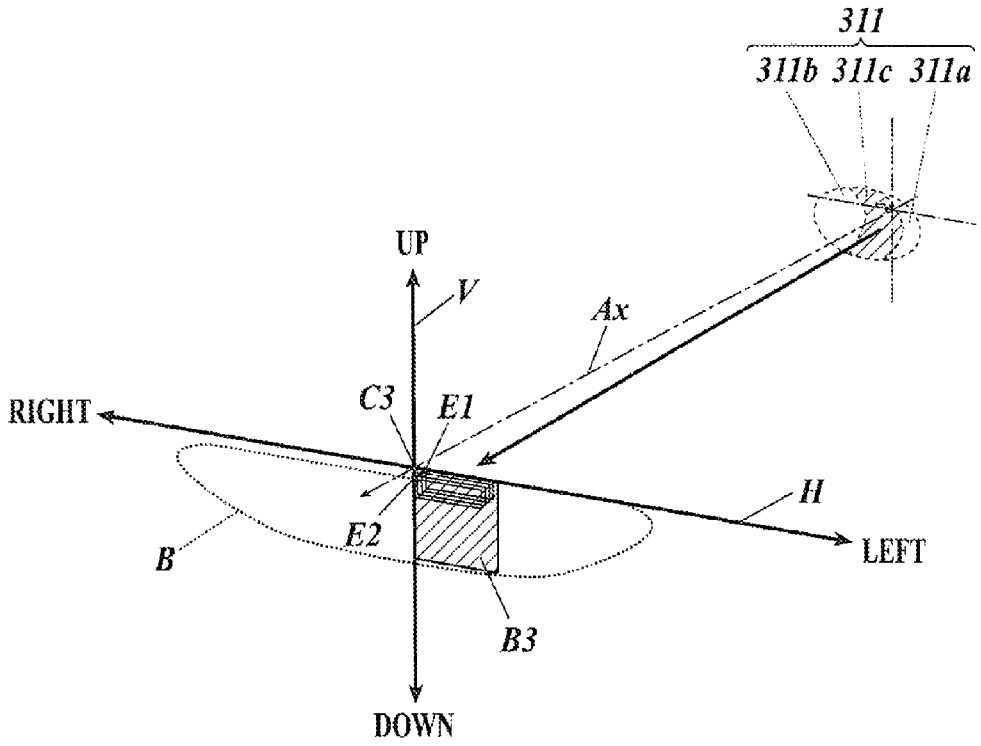
FIG. 8 shows a projection image formed by a third refracting surface of the first incidence surface and the exit surface of the projector lens of FIG. 1.
Figure 9:
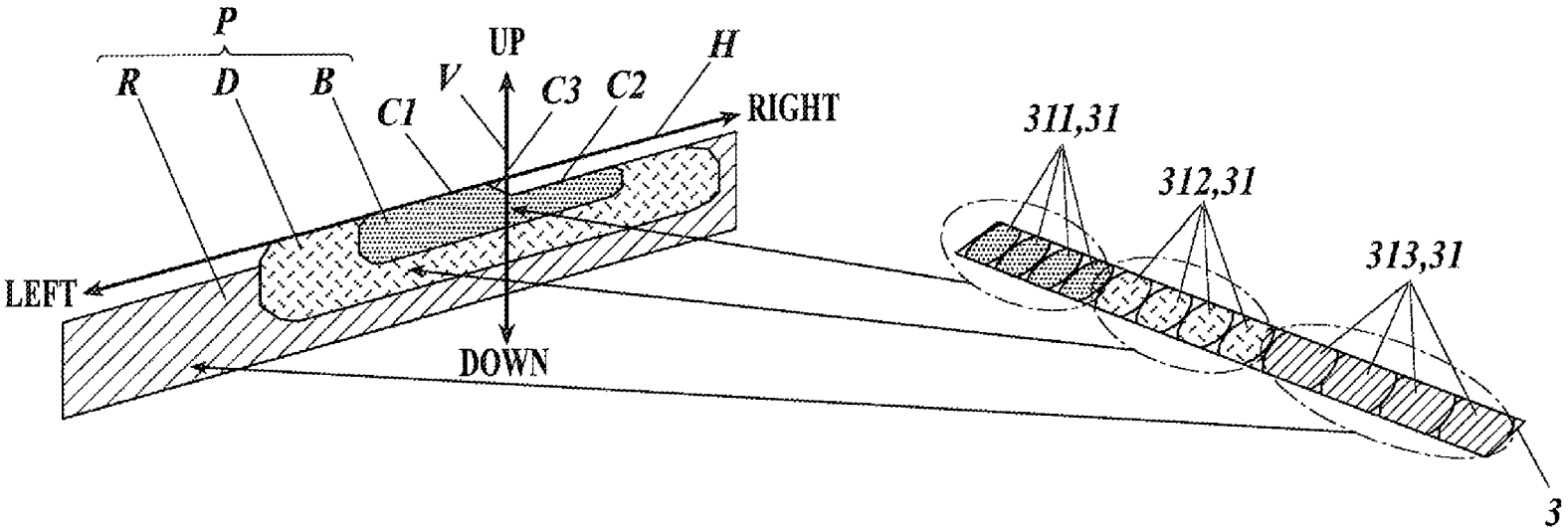
FIG. 9 schematically shows a projection image formed by the projector lens of FIG. 1.

FIG. 6 shows a projection image formed by the first refracting surface 311*a* of the first incidence surface 311 and the exit surface 32 of the projector lens 3. FIG. 7 shows a projection image formed by the second refracting surface 311*b* of the first incidence surface 311 and the exit surface 32 of the projector lens 3. FIG. 8 shows a projection image formed by the third refracting surface 311*c* of the first incidence surface 311 and the exit surface 32 of the projector lens 3. FIG. 9 schematically shows a projection image (light distribution pattern) formed by the projector lens 3.

FIGS. 6 to 9 show the projection images which are formed on a virtual screen located in front of the vehicle lighting device 1 with a predetermined distance between the virtual screen and the vehicle lighting device 1.

As shown in FIG. 6, the light emitted to the front of the vehicle through the first refracting surface 311*a* of the first incidence surface 311 and the exit surface 32 illuminates an illumination region B1 by arranging reverse projection images I formed by beams of the light in the up-down direction and in the right-left direction. The illumination region B1 is located on the left of a point E1 which is on a horizontal line H and a little left (own-lane side) from a vertical line V, and below the horizontal line H. Each of the horizontal line H and the vertical line V intersects with the optical axis Ax. The upper edge of the illumination region B1, the upper edge which is along the horizontal line H, constitutes an own-lane side horizontal cutoff line C1.

As shown in FIG. 7, the light emitted to the front of the vehicle through the second refracting surface 311*b* of the first incidence surface 311 and the exit surface 32 illuminates an illumination region B2 by arranging reverse projection images I formed by beams of the light in the up-down direction and in the right-left direction. The illumination region B2 is located below a point E2 which is a little below the horizontal line H (0.6 degrees downward from the exit surface 32) and on the vertical line V. The illumination region B2 includes a predetermined area on the right (opposite-lane side) of the optical axis Ax. The upper edge of the illumination region B2, the upper edge which passes through the point E2, and which is parallel with the horizontal line H, constitutes an opposite-lane side horizontal cutoff line C2.

As shown in FIG. 8, the light emitted to the front of the vehicle through the third refracting surface 311*c* of the first incidence surface 311 and the exit surface 32 illuminates an illumination region B3 by arranging reverse projection images I formed by beams of the light in the up-down direction and in an oblique direction. The illumination region B3 is located below the point E1 and on the left of the point E2, and below an oblique line which is formed by connecting the point E1 to the point E2, and which is inclined at an angle of about 45 degrees to the horizontal line H (or the vertical line V). The edge of the illumination region B3 connecting the point E1 to the point E2, namely, the oblique line, constitutes an oblique cutoff line C3.

In the illumination regions B1, B2, and B3, the vicinities of the own-lane side horizontal cutoff line C1, the opposite-lane side horizontal cutoff line C2, and the oblique cutoff line C3 are the brightest, respectively. Then, as it is away from the cutoff lines downward, it becomes gradually darker. This is because the deflection angle to emit the light downward with the first refracting surface 311*a*, the second refracting surface 311*b*, or the third refracting surface 311*c* becomes gradually larger as the light is emitted away from the optical axis Ax in the up-down direction.

A first cutoff line portion B which includes the cutoff lines C1, C2, and C3 is formed by combining the illumination regions B1, B2, and B3.

As shown in FIG. 9, the light emitted to the front of the vehicle through the second incidence surface 312 and the exit surface 32 forms a second cutoff line portion D, the upper edge of which coincides with the upper edge of the first cutoff line portion B, and which is larger (further spreads) than the first cutoff line portion B in the right direction, in the left direction, and in the down direction.

More specifically, although not being shown, in a similar manner to the light emitted to the front of the vehicle through the first refracting surface 311*a* of the first incidence surface 311 and the exit surface 32, the light emitted to the front of the vehicle through the first refracting surface 312*a* of the second incidence surface 312 and the exit surface 32 illuminates a region. The region is a region, the upper edge of which coincides with the own-lane side horizontal cutoff line C1, and which is larger than the illumination region B1 in the left direction and in the down direction. Also, in a similar manner to the light emitted to the front of the vehicle through the second refracting surface 311*b* of the first incidence surface 311 and the exit surface 32, the light emitted to the front of the vehicle through the second refracting surface 312*b* of the second incidence surface 312 and the exit surface 32 illuminates a region. The region is a region, the upper edge of which coincides with the opposite-lane side horizontal cutoff line C2, and which is larger than the illumination region B2 in the right direction and in the down direction. Also, in a similar manner to the light emitted to the front of the vehicle through the third refracting surface 311*c* of the first incidence surface 311 and the exit surface 32, the light emitted to the front of the vehicle through the third refracting surface 312*c* of the second incidence surface 312 and the exit surface 32 illuminates a region. The region is a region, the upper edge of which coincides with the oblique cutoff line C3 and the horizontal line H, and which is larger than the illumination region B3 in the down direction. The second cutoff line portion D which includes the cutoff lines C1, C2, and C3 is formed by combining these regions.

The light emitted to the front of the vehicle through the third incidence surface 313 and the exit surface 32 forms a diffusion light distribution portion R. The diffusion light distribution portion R is located below the point E1, and is larger than the second cutoff line portion D in the right direction, in the left direction, and in the down direction. The diffusion light distribution portion R is larger than the second cutoff line portion D in the left direction, in particular.

Low beams P are formed by combining the first cutoff line portion B, the second cutoff line portion D, and the diffusion light distribution portion R.

According to the vehicle lighting device 1 described above, the projector lens 3 includes the incidence surfaces 31 which respectively correspond to the LEDs 2, and the single exit surface 32. In the exit surface 32, the exit regions which are next to each other overlap with each other. The exit regions emit the light entering through the incidence surfaces 31 into the projector lens 3, respectively. Accordingly, the light emitted from the LEDs 2 can be emitted from the single exit surface 32 with no gap. Therefore, on the contrary to the case where a plurality of projector lenses is arranged or connected, the exit surface 32 does not have a dark portion therein, and accordingly, can emit light as a whole. Hence, the vehicle lighting device 1 looks excellent when emitting light.

Furthermore, the incidence surfaces 31 of the projector lens 3 perform the main control of the light distribution. Accordingly, on the contrary to the case where a plurality of convex exit surfaces which performs the control of the light distribution is arranged or connected, the exit surface 32 can be a single surface having high degree of freedom in designing. Consequently, the exit surface 32 which acts as a light-emitting portion (a light-emitting portion of the vehicle lighting device 1) can be formed in a smooth shape, and can fit the design of the external appearance of a vehicle. Hence, the external appearance of the vehicle lighting device 1 can be excellent.

Next, a modification of the exemplary embodiment is described. The components similar to the components in the exemplary embodiment are denoted by the same numeral references, and the description thereof is omitted.

Figure 10:
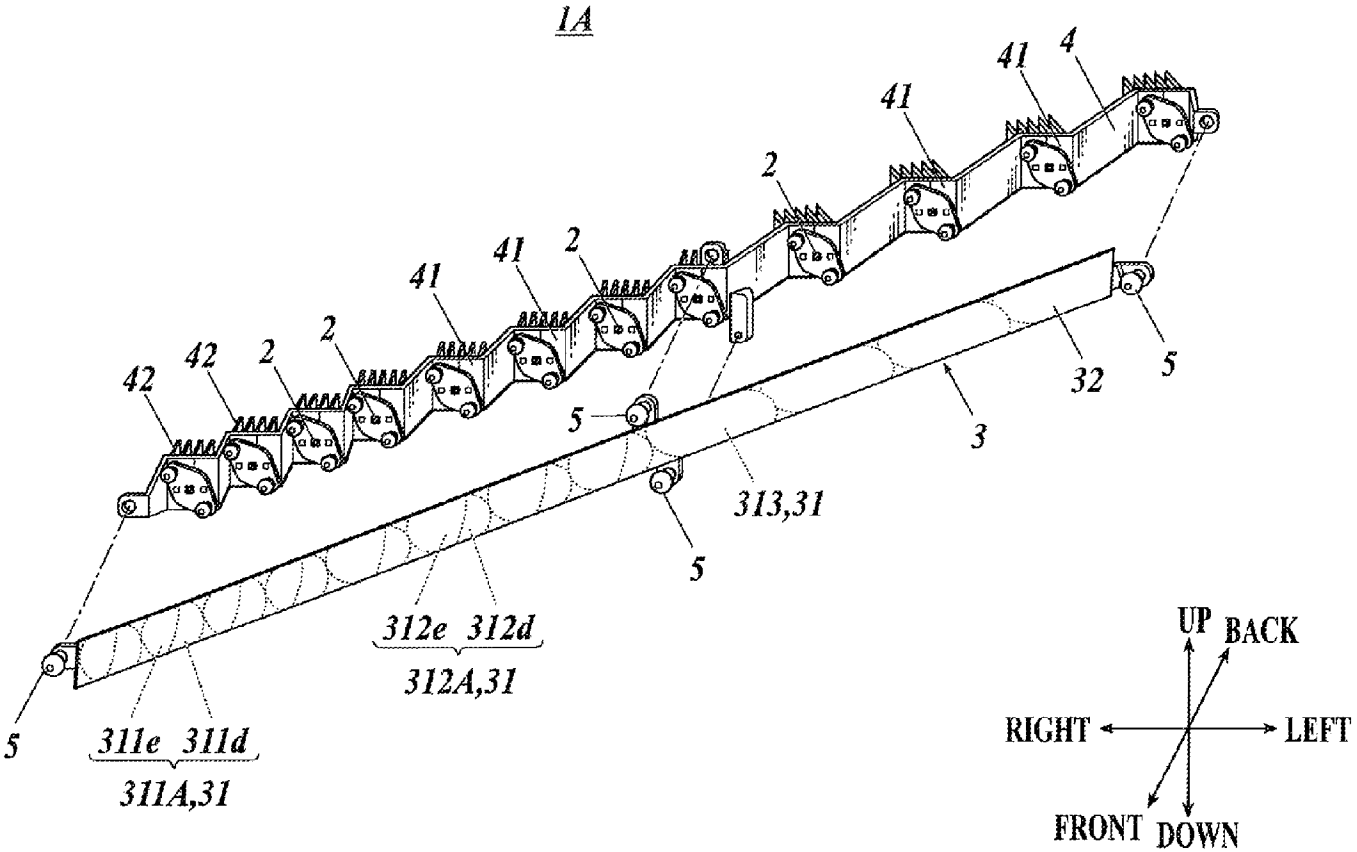
FIG. 10 is an exploded perspective view of a vehicle lighting device according to a modification of the lighting device of FIG. 1.

FIG. 10 is an exploded perspective view of a vehicle lighting device 1A according to the modification.

As shown in FIG. 10, a projector lens 3 of the vehicle lighting device 1A includes a first incidence surface 311A and a second incidence surface 312A instead of the first incidence surface 311 and the second incidence surface 312 of the exemplary embodiment. The first incidence surface 311A and the second incidence surface 312A are convex, which is the same as the first incidence surface 311 and the second incidence surface 312 of the exemplary embodiment. However, each of the first incidence surface 311A and the second incidence surface 312A is composed of two refracting surfaces, not three refracting surfaces (the first, second, and third refracting surfaces 311*a*, 311*b*, and 311*c*, or the first, second, and third refracting surfaces 312*a*, 312*b*, and 312*c*) as described in the exemplary embodiment.

More specifically, the first incidence surface 311A is composed of a first refracting surface 311*d* formed on the own-lane side (left) and a second refracting surface 311*e* formed on the opposite-lane side (right). The second incidence surface 312A is composed of a first refracting surface 312*d* formed on the own-lane side (left) and a second refracting surface 312*e* formed on the opposite-lane side (right).

Figure 11:
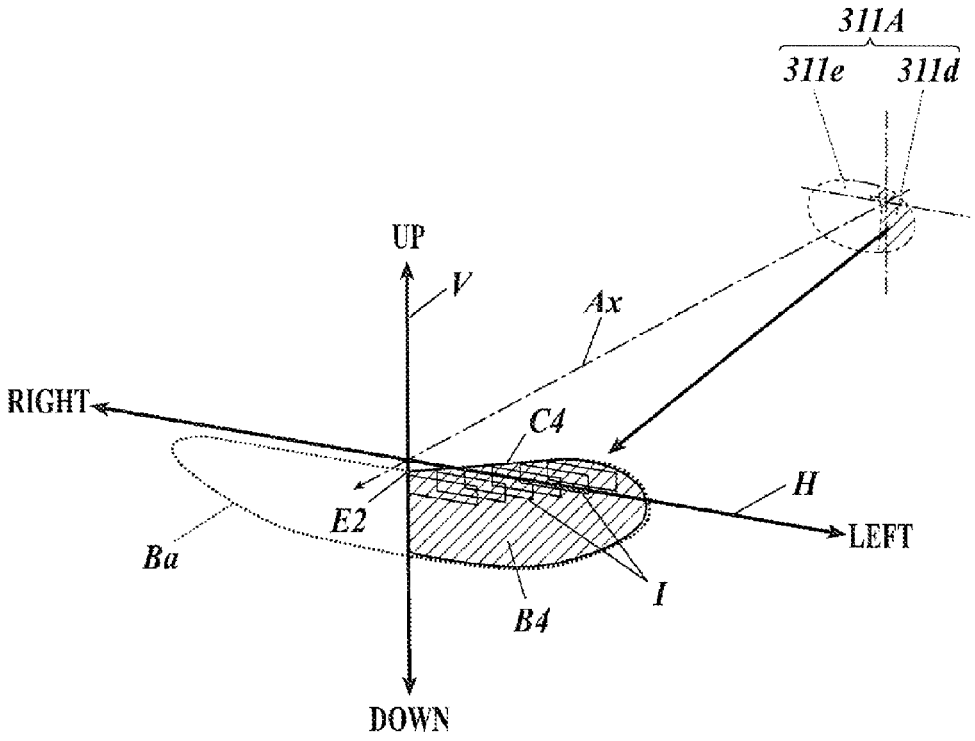
FIG. 11 shows a projection image formed by a first refracting surface of a first incidence surface and an exit surface of a projector lens of the vehicle lighting device of FIG. 10.
Figure 12:
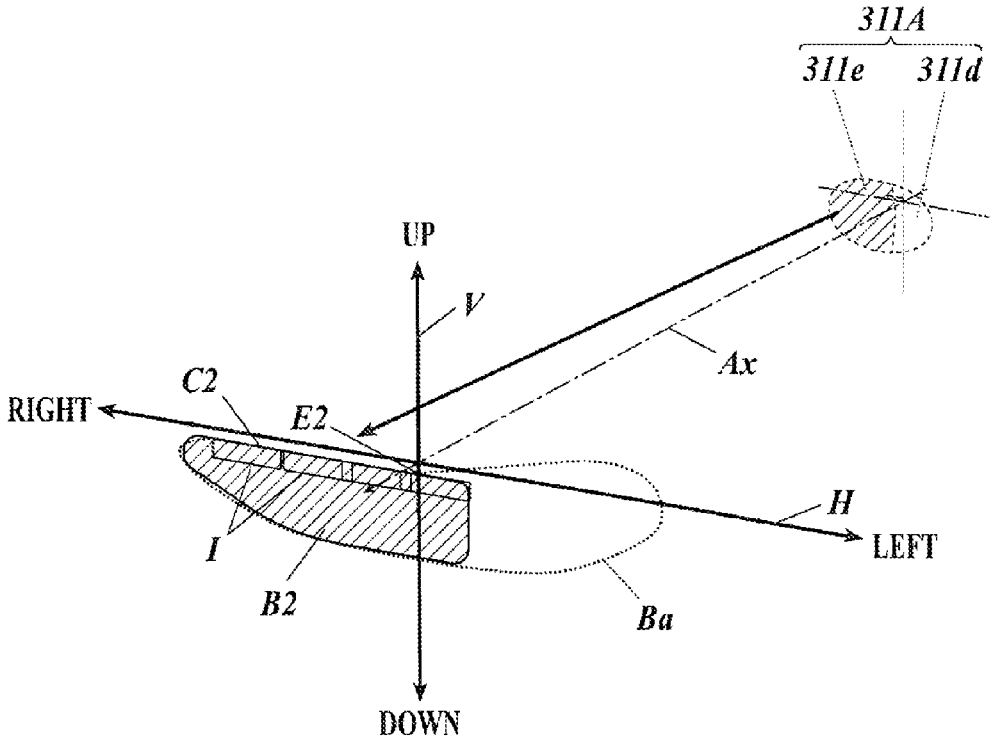
FIG. 12 shows a projection image formed by a second refracting surface of the first incidence surface and the exit surface of the projector lens of FIG. 10.
Figure 13:
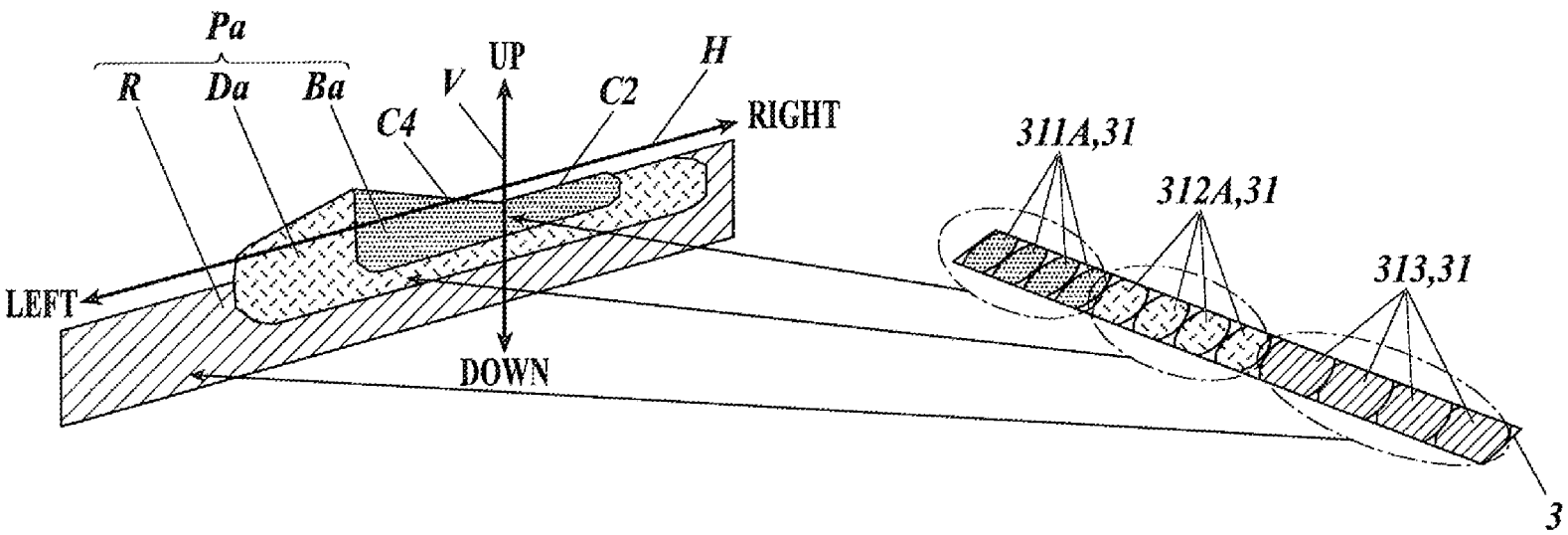
FIG. 13 schematically shows a projection image formed by the projector lens of FIG. 10.

FIG. 11 shows a projection image formed by the first refracting surface 311*d* of the first incidence surface 311A and the exit surface 32 of the projector lens 3. FIG. 12 shows a projection image formed by the second refracting surface 311*e* of the first incidence surface 311A and the exit surface 32 of the projector lens 3. FIG. 13 schematically shows a projection image (light distribution pattern) formed by the projector lens 3 of the vehicle lighting device 1A.

FIGS. 11 to 13 show the projection images which are formed on a virtual screen located in front of the vehicle lighting device 1A with a predetermined distance between the virtual screen and the vehicle lighting device 1A.

As shown in FIG. 11, the light emitted to the front of the vehicle through the first refracting surface 311*d* of the first incidence surface 311A and the exit surface 32 illuminates an illumination region B4 by arranging reverse projection images I formed by beams of the light in the up-down direction and in an inclined direction. The illumination region B4 is located on the left of the point E2, and below an inclined line which is inclined at an angle of about 15 degrees toward the upper-left direction from the point E2. The upper edge of the illumination region B4, namely, the inclined line which is inclined at an angle of about 15 degrees toward the upper-left direction from the point E2, forms an own-lane side oblique cutoff line C4 on the own-lane side (left).

As shown in FIG. 12, in a similar manner to the light emitted to the front of the vehicle through the second refracting surface 311*b* of the first incidence surface 311 and the exit surface 32 of the exemplary embodiment, the light emitted to the front of the vehicle through the second refracting surface 311*e* of the first incidence surface 311A and the exit surface 32 illuminates the illumination region B2 which includes the opposite-lane side horizontal cutoff line C2.

A first cutoff line portion Ba which includes the own-lane side oblique cutoff line C4 and the opposite-lane side horizontal cutoff line C2 is formed by combining the illumination regions B4 and B2.

As shown in FIG. 13, the light emitted to the front of the vehicle through the second incidence surface 312A and the exit surface 32 forms a second cutoff line portion Da, the upper edge of which coincides with the upper edge of the first cutoff line portion Ba, and which is larger than the first cutoff line portion Ba in the right direction, in the left direction, and in the down direction.

More specifically, although not being shown, in a similar manner to the light emitted to the front of the vehicle through the first refracting surface 311*d* of the first incidence surface 311A and the exit surface 32, the light emitted to the front of the vehicle through the first refracting surface 312*d* of the second incidence surface 312A and the exit surface 32 illuminates a region. The region is a region, the upper edge of which coincides with the own-lane side oblique cutoff line C4, and which is larger than the illumination region B4 in the left direction and in the down direction. Also, in a similar manner to the light emitted to the front of the vehicle through the second refracting surface 311*e* of the first incidence surface 311A and the exit surface 32, the light emitted to the front of the vehicle through the second refracting surface 312*e* of the second incidence surface 312A and the exit surface 32 illuminates a region. The region is a region, the upper edge of which coincides with the opposite-lane side horizontal cutoff line C2, and which is larger than the illumination region B2 in the right direction and in the down direction. The second cutoff line portion Da which includes the own-lane side oblique cutoff line C4 and the opposite-lane side horizontal cutoff line C2 is formed by combining these regions.

Low beams Pa are formed by combining the diffusion light distribution portion R, which is formed by the third incidence surface 313 and the exit surface 32, with the first cutoff line portion Ba and the second cutoff line portion Da. The low beams Pa include the own-lane side oblique cutoff line C4 which is inclined at an angle of about 15 degrees.

The vehicle lighting device 1A of the modification can obtain the same advantageous effects as the vehicle lighting device 1 of the exemplary embodiment.

The presently disclosed subject matter is not limited to the exemplary embodiment and the modification, and, needless to say, appropriate changes and improvements can be made.

For example, in the exemplary embodiment and the modification, the first incidence surface 311 or 311A and the second incidence surface 312 or 312A are composed of three or two refracting surfaces, whereby the first cutoff line portion B or Ba and the second cutoff line portion D or Da are formed. Alternatively, light blocking materials which can form cutoff lines may be provided for the light-emitting portions of the LEDs 2.

Figure 14:
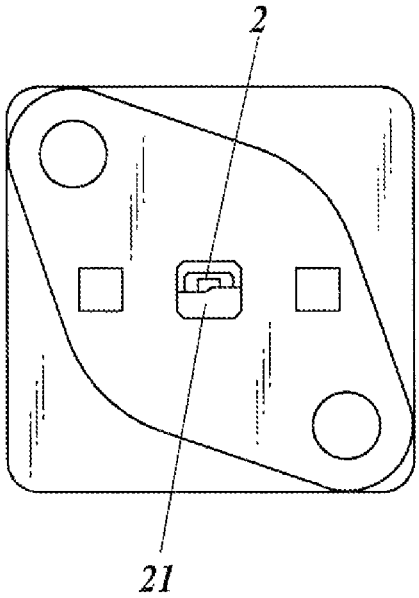
FIG. 14 shows an LED of the lighting device of FIG. 10.

More specifically, as shown in FIG. 14, light blocking materials 21, which can form the cutoff lines C1, C2, and C3 by blocking some of the light emitted from the LEDs 2, the unblocked light passing through the projector lens 3 so as to form the cutoff lines C1, C2, and C3, may be provided for the light-emitting portions of eight LEDs 2 which respectively correspond to the first incidence surfaces 311 and the second incidence surfaces 312, whereby the first cutoff line portion B and the second cutoff line portion D can be formed.

Figure 15:
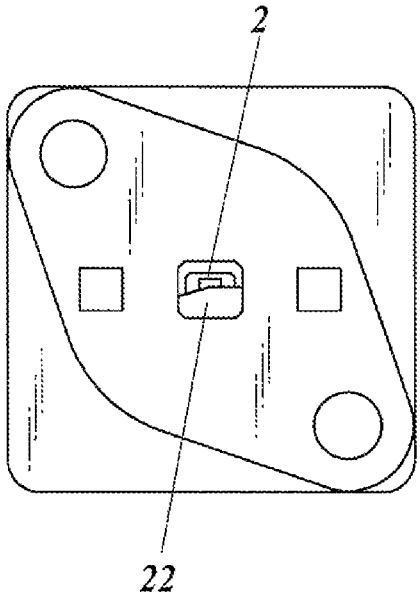
FIG. 15 shows an LED of the lighting device of FIG. 10.

Furthermore, as shown in FIG. 15, light blocking materials 22, which can form the cutoff lines C2 and C4 by blocking some of the light emitted from the LEDs 2, the unblocked light passing through the projector lens 3 so as to form the cutoff lines C2 and C4, may be provided for the light-emitting portions of eight LEDs 2 which respectively correspond to the first incidence surfaces 311A and the second incidence surfaces 312A, whereby the first cutoff line portion Ba and the second cutoff line portion Da can be formed.

The exit surface 32 of the projector lens 3 is not necessary to be an inclined plane. As long as a desired light distribution pattern can be obtained with the incidence surfaces 31, the exit surface 32 may be an adjustable surface such as a two-dimensional surface.

Bracket 4 which holds the LEDs 2 can be made of a material having excellent thermal conductivity, such as an aluminum alloy, in order to effectively remove heat generated by the LEDs 2. It is also possible to place an element between the bracket 4 and the LEDs 2, for example, an element which facilitates thermal conduction, such as thermal conductive grease.

According to the exemplary embodiment of the presently disclosed subject matter, there is provided a vehicle lighting device including: a plurality of semiconductor light-emitting devices; a projector lens which illuminates a front of a vehicle with light emitted from the semiconductor light-emitting devices, the projector lens including: a plurality of incidence surfaces which performs main control of light distribution, and respectively corresponds to the semiconductor light-emitting devices; and a single exit surface including a plurality of exit regions which emits the light entering through the incidence surfaces into the projector lens, wherein the exit regions provided next to each other overlap with each other.

In the vehicle lighting device, the incidence surfaces can include a cutoff-line-making incidence surface which makes a cutoff line of a low beam, and the cutoff-line-making incidence surface includes: a first refracting surface provided on an own-lane side of the cutoff-line-making incidence surface, the first refracting surface which makes an own-lane side horizontal cutoff line; a second refracting surface provided on an opposite-lane side of the cutoff-line-making incidence surface, the second refracting surface which makes an opposite-lane side horizontal cutoff line; and a third refracting surface provided between the first refracting surface and the second refracting surface of the cutoff-line-making incidence surface, the third refracting surface which makes an oblique cutoff line connecting the own-lane side horizontal cutoff line to the opposite-lane side horizontal cutoff line.

In the vehicle lighting device, the incidence surfaces can include a cutoff-line-making incidence surface which makes a cutoff line of a low beam, and the cutoff-line-making incidence surface includes: a first refracting surface provided on an own-lane side of the cutoff-line-making incidence surface, the first refracting surface which makes an own-lane side oblique cutoff line; and a second refracting surface provided on an opposite-lane side of the cutoff-line-making incidence surface, the second refracting surface which makes an opposite-lane side horizontal cutoff line.

In the vehicle lighting device, the semiconductor light-emitting devices can include a blocking-material-provided light-emitting device provided with a light blocking material in front of a light-emitting portion of the blocking-material-provided light-emitting device, and the light blocking material blocks a part of light emitted from the blocking-material-provided light-emitting device so as to make a cutoff line of a low beam.

According to the exemplary embodiment and the modification of the presently disclosed subject matter, a projector lens includes a plurality of incidence surfaces respectively corresponding to a plurality of semiconductor light-emitting devices, and a single exit surface. The exit surface includes a plurality of exit regions which emits light entering through the incidence surfaces into the projector lens, respectively. The exit regions which are next to each other overlap with each other. Consequently, the light emitted from the semiconductor light-emitting devices can be emitted from the single exit surface with no gap. Accordingly, on the contrary to the case where a plurality of projector lenses is arranged or connected, the exit surface can emit light as a whole, and a vehicle lighting device looks excellent when emitting light.

Furthermore, because the plurality of incidence surfaces performs the main control of the light distribution, on the contrary to the case where a plurality of convex exit surfaces which performs the control of the light distribution is arranged or connected, the exit surface can be a single surface having high degree of freedom in designing. Accordingly, the exit surface which acts as a light-emitting portion (a light-emitting portion of the vehicle lighting device) can be formed in a smooth shape, and can fit the design of the eternal appearance of a vehicle. Hence, the external appearance of the vehicle lighting device can be excellent.

The entire disclosure of Japanese Patent Application No. 2010-268049 filed on Dec. 1, 2010 including description, claims, drawings, and abstract are incorporated herein by reference in its entirety.

Although various exemplary embodiments have been shown and described, the presently disclosed subject matter is not limited to the exemplary embodiments shown. The scope of the presently disclosed subject matter is intended to be limited solely by the scope of the claims that follow.

What is claimed is:

1. A vehicle lighting device comprising:

a plurality of semiconductor light-emitting devices;

a projector lens configured to illuminate a front of a vehicle with light emitted from the semiconductor light-emitting devices, the projector lens including:

a plurality of incidence surfaces configured to perform main control of light distribution, and which respectively corresponds to the semiconductor light-emitting devices; and a single exit surface including a plurality of exit regions configured to emit light which has entered through the incidence surfaces into the projector lens, wherein exit regions provided next to each other overlap with each other, wherein the incidence surfaces include a cutoff-line-making incidence surface which makes a cutoff line of a low beam, and wherein the cutoff-line-making incidence surface includes:

a first refracting surface provided on an own-lane side of the cutoff-line-making incidence surface, the first refracting surface makes an own-lane side horizontal cutoff line;

a second refracting surface provided on an opposite-lane side of the cutoff-line-making incidence surface, the second refracting surface makes an opposite-lane side horizontal cutoff line; and a third refracting surface provided between the first refracting surface and the second refracting surface of the cutoff-line-making incidence surface, the third refracting surface makes an oblique cutoff line connecting the own-lane side horizontal cutoff line to the opposite-lane side horizontal cutoff line.

2. The vehicle lighting device according to claim 1, wherein the semiconductor light-emitting devices include a blocking-material-provided light-emitting device provided with a light blocking material in front of a light-emitting portion of the blocking-material-provided light-emitting device, and wherein the light blocking material blocks a part of light emitted from the blocking-material-provided light-emitting device so as to make a cutoff line of a low beam.

3. A vehicle lighting device comprising:

a plurality of semiconductor light-emitting devices;

a projector lens configured to illuminate a front of a vehicle with light emitted from the semiconductor light-emitting devices, the projector lens including:

a plurality of incidence surfaces configured to perform main control of light distribution, and which respectively corresponds to the semiconductor light-emitting devices; and a single exit surface including a plurality of exit regions configured to emit light which has entered through the incidence surfaces into the projector lens, wherein exit regions provided next to each other overlap with each other, wherein the incidence surfaces include a cutoff-line-making incidence surface which makes a cutoff line of a low beam, and wherein the cutoff-line-making incidence surface includes:

a first refracting surface provided on an own-lane side of the cutoff-line-making incidence surface, the first refracting surface makes an own-lane side oblique cutoff line; and a second refracting surface provided on an opposite-lane side of the cutoff-line-making incidence surface, the second refracting surface makes an opposite-lane side horizontal cutoff line.

* * * * *